US005652089A

United States Patent [19]

Saitou

[11] Patent Number: 5,652,089

[45] Date of Patent: Jul. 29, 1997

[54] SILVER HALIDE PHOTOGRAPHIC EMULSION

[75] Inventor: Mitsuo Saitou, Kanagawa, Japan

[73] Assignee: Fuji Photo Film Co., Ltd., Kanagawa, Japan

[21] Appl. No.: 470,021

[22] Filed: Jun. 6, 1995

Related U.S. Application Data

[63] Continuation of Ser. No. 102,833, Aug. 6, 1993, abandoned.

[30] Foreign Application Priority Data

Aug. 11, 1992 [JP] Japan ..... 4-214109

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,063,951 | 12/1977 | Bogg | 430/569 |
| 4,414,304 | 11/1983 | Dickerson | 430/567 |
| 4,946,772 | 8/1990 | Ogawa | 430/567 |
| 5,264,337 | 11/1993 | Maskasky | 430/567 |
| 5,292,632 | 3/1994 | Maskasky | 430/567 |
| 5,320,938 | 6/1994 | House et al. | 430/567 |

FOREIGN PATENT DOCUMENTS

| | | |
|---|---|---|
| 460656 | 12/1991 | European Pat. Off. . |
| 2295454 | 7/1976 | France . |

*Primary Examiner*—Richard L. Schilling

*Attorney, Agent, or Firm*—Sughrue, Mion, Zinn, Macpeak & Seas

[57] ABSTRACT

A silver halide emulsion comprises silver halide grains 35% or more of the total projected area of which are tabular grains having a {100} plane as a main plane and having an average aspect ratio of 1.3 to 7.9 which have been prepared via at least nucleation and ripening procedures. The emulsion is characterized in that said ripening procedure is conducted with substantially no $NH_3$ present in the system. In a preferred embodiment, the ripening procedure is followed by the addition of fine silver halide grains substantially free of screw dislocation defects and having a diameter of 0.15 μm or less that causes crystal growth. The nucleation is effected by the simultaneous addition of a silver salt and a halide salt solution to a dispersant solution. The resulting nuclei have a $Br^-$ content of 60 mol % or more. $Cl^-$ is present in said dispersant solution in an amount of $10^{-5}$ mol/l or more before the simultaneous addition.

6 Claims, 1 Drawing Sheet

SILVER HALIDE PHOTOGRAPHIC EMULSION

This is a Continuation of application Ser. No. 08/102,833 filed Aug. 6, 1993, now abandoned.

FIELD OF THE INVENTION

The present invention relates to a silver halide photographic emulsion (hereinafter referred to as "AgX" emulsion).

BACKGROUND OF THE INVENTION

An AgX emulsion comprising tabular grains having a {100} plane as a main plane and an aspect ratio of 1.5 to 7.0 which has been prepared via at least nucleation and ripening procedures is disclosed in U.S. Pat. No. 4,063,951. In the preparation of such an AgX emulsion, however, it is essential that $NH_3$ be present in the system in an amount of 0.1 to 1.0 mol/l during the ripening procedure. If the ripening procedure is effected with $NH_3$ present in the system, the resulting tabular grains have a low aspect ratio but have a disadvantage that they have a high fog density.

On the other hand, U.S. Pat. No. 4,386,156 discloses an AgX emulsion comprising tabular grains having an aspect ratio as high as 8 or more which has been ripened with no AgX solvent present in the system. However, tabular grains having an average aspect ratio of 8 or more are disadvantageous in that when incorporated in a photographic light-sensitive material, the resulting photographic light-sensitive material exhibits pressure characteristics poor enough to cause pressure fog. Accordingly, it has been desired to develop an AgX emulsion comprising tabular grains having an aspect ratio of less than 8 which is insusceptible to pressure fog and exhibits a low fog density. However, such an AgX emulsion is unknown. Such tabular grains are characterized by a higher color-sensitizability than other AgX grains.

Since all the grains disclosed in the above cited patents have been prepared via nucleation and ripening procedures only, there occurs another problem in that the resulting yield of AgX emulsion is too low and a free or variable control of the grain diameter can not be obtained.

SUMMARY OF THE INVENTION

It is therefore an object of the invention to provide a high yield of an AgX emulsion comprising AgX grains 35% or more of the total projected area of which are tabular grains having a {100} plane as a main plane and having an average aspect ratio of 1.3 to 7.9 which exhibit a low fog density, a high color-sensitizability and excellent sensitivity and graininess and are insusceptible to pressure fog.

The foregoing object of the present invention will become more apparent from the following detailed description and examples.

The foregoing object of the present invention has been accomplished with a silver halide emulsion comprising silver halide grains 35% or more of the total projected area of which is occupied by tabular grains having a {100} plane as a main plane and an average aspect ratio of 1.3 to 7.9 which have been prepared via at least nucleation and ripening procedures, characterized in that said ripening procedure is conducted with substantially no $NH_3$ present in the system.

The foregoing object of the present invention has also been accomplished with a silver halide emulsion as defined above, wherein said ripening procedure is followed by the addition of fine silver halide grains substantially free of screw dislocation defects and having a diameter of 0.15 μm or less that causes crystal growth.

The foregoing object of the present invention has further been accomplished with a silver halide emulsion as defined above, wherein said nucleation is effected by the simultaneous addition of a silver salt and a halide solution to a dispersant solution, the resulting nuclei have a $Br^-$ content of 60 mol % or more, and $Cl^-$ is present in said dispersant solution in an amount of $10^{-5}$ mol/l or more before the simultaneous addition.

The foregoing object of the present invention has furthermore been accomplished with a silver halide emulsion as defined above, wherein said tabular grains have screw dislocation defects, and said screw dislocation defects are formed by a lattice constant disorder in which a high AgCl phase containing 60 mol % or more of AgCl is joined with a high AgBr phase containing 60 mol % or more of AgBr.

BRIEF DESCRIPTION OF THE DRAWING

By way of example and to make the description more clear, reference is made to the accompanying drawing in which.

DETAILED DESCRIPTION OF THE INVENTION

Figure 1A:
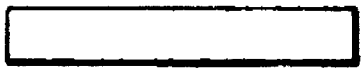
FIG. 1 illustrates examples of the halogen composition configuration inside seven (7) kinds of grains wherein the shadow and the white background indicate different halogen compositions from each other.

In the AgX emulsion of the present invention, 35% or more, preferably 60% or more, more preferably 80% or more of the total projected area of all AgX grains is occupied by tabular grains having a {100} plane as a main plane. These tabular grains exhibit an average aspect ratio of 1.3 to 7.9, preferably 2 to 7.6, more preferably 3 to 7.0, most preferably 3 to 6.3. The average $Cl^-$ content in the tabular grains is 0 to 100 mol %, preferably 0 to 49 mol %, more preferably 0 to 40 mol %, further preferably 0 to 20 mol %. The thickness of the tabular grains is preferably 0.8 μm or less, preferably 0.05 to 0.5 μm. The average projected grain diameter of these tabular grains is preferably in the range of 10 μm or less, more preferably 0.2 to 5 μm. The aspect ratio as defined herein is equal to the diameter/thickness ratio of a tabular grain. The diameter of a tabular grain as defined herein is equal to the diameter of the circle having the same area as the projected area of the tabular grains observed under a microscope. The thickness of a tabular grain as defined herein is equal to the distance between the main planes of the tabular grain. The average aspect ratio of tabular grains as defined herein is the average value of the aspect ratios of all the tabular grains. The average projected grain diameter as defined herein is the arithmetic mean of the diameter of all the tabular grains. The main plane of a tabular grain as defined herein comprises two parallel largest external surfaces of the tabular grain. The grain size distribution of the tabular grains is preferably monodisperse. The variation coefficient of the grain size of the tabular grains is preferably in the range of 40% or less, more preferably 0 to 30%.

The emulsion of the present invention is prepared via at least nucleation and ripening procedures. Beginning with the nucleation procedure, these procedures will be further described below.

1) Nucleation Procedure

An $AgNO_3$ solution and a halide (hereinafter referred to as "$X^-$ salt") solution are added to a dispersant solution containing at least a dispersant and water with stirring by a double jet process to cause nucleation. In the case where the AgX nuclei formed during nucleation preferably exhibit a $Br^-$ content of 60 mol % or more, more preferably 80 mol % or more (hereinafter referred to as "Case (A)"), the following nucleation conditions are preferred.

The $Br^-$ concentration in the dispersant solution during nucleation is preferably in the range of $10^{-2.3}$ mol/l or less, more preferably $10^{-2.6}$ mol/l or less, further preferably $10^{-3}$ mol/l or less. The $Ag^+$ concentration is preferably in the range of $10^{-4}$ to $10^{-1.6}$ mol/l, more preferably in the range of $10^{-3.5}$ to $10^{-2}$ mol/l. Further, $Cl^-$ is incorporated in the dispersant solution in an amount of $10^{-5}$ mol/l or more, preferably $10^{-4.5}$ to $10^{-3.2}$ mol/l, more preferably $10^{-4.2}$ to $10^{-3.5}$ mol/l before the double jet process is carried out. In this case, the double jet process is preferably effected after the addition of an $AgNO_3$ solution to a dispersant solution free of $Cl^-$ followed by the addition of $Cl^-$ salt. The dispersant solution free of $Cl^-$ preferably has a $Cl^-$ content of $10^3$ ppm or less, more preferably $10^2$ ppm or less, further preferably 10 ppm or less. The amount of $AgNO_3$ to be added is preferably in the range of $10^{-4}$ to $10^{-1.6}$ mol/l, more preferably $10^{-3.5}$ to $10^{-2}$ mol/l . The amount of $Cl^-$ to be subsequently added is preferably in the range of $10^{-5}$ mol/l or more, more preferably $10^{-4.5}$ to $10^{-3.2}$ mol/l, further preferably $10^{-4.2}$ to $10^{-3.5}$ mol/l.

The temperature at which nucleation is effected is not limited but normally is preferably in the range of 10° C. or higher, more preferably 20° to 75° C. The nucleation procedure is followed by a physical ripening procedure that causes the disappearance of nontabular grains and the growth of tabular grains. However, if the nucleation temperature is high, nucleation may be accompanied by ripening. The rate at which $Ag^+$ salt is added to the system is preferably in the range of 2 to 30 g/min., more preferably 4 to 20 g/min. per l of solution in the container. The duration of nucleation is preferably in the range of 10 minutes or less, more preferably 5 seconds to 5 minutes, even more preferably 10 seconds to 3 minutes. The pH value of the solution in the container is not specifically limited but is normally in the range of 1 to 11, preferably 3 to 10. The most suitable pH value can be selected depending on factors such as excessive $Ag^+$ concentration, temperature, etc.

In order to allow the tabular grains to grow, it is necessary that crystal defects such as screw dislocations be incorporated in the grains to accelerate the crystal growth thereof in a specific direction. It is not yet verified experimentally that the crystal defects are screw dislocations. However, the "crystal defects which accelerate crystal growth" hereinafter, refers to screw dislocation defects.

For the relationship between the nucleation conditions and the probability of occurrence of screw dislocation defects, reference can be made to Japanese Patent Application No. 4-145031. If the probability of occurrence of the defects is lowered, the shape of the main plane of the resulting tabular grains becomes close to square. This can be considered a grain having one diagonal defect line on the square. On the contrary, if the probability of occurrence of the defects is enhanced, rod grains having one line of such a defect along its {100} plane or grains having an adjacent edge ratio of 1.2 or more or tabular grains having a low aspect ratio (having the foregoing defect with vectors in the x, y and z directions) may be mixed in the system. Accordingly, the probability of occurrence of the defects may be properly adjusted to suppress the percentage mixing of low aspect grains within the allowable range and hence increase the probability of occurrence of tabular grains. The adjacent edge ratio as defined herein is equal to the ratio of longest edge/shortest edge in four edges forming one main plane. The x and y axes are on a plane parallel to the {100} plane of the grain, and the x axis extends perpendicular to the {100} plane. These axes form rectangular coordinates.

In this case, the greater the amount of $Cl^-$ to be added before the double jet process is carried out, the higher is the probability of occurrence of the defects. Under these conditions, AgCl nuclei or AgX nuclei having a high AgCl content are formed at first. To the nuclei are then added an $X^-$ salt solution having a high $Br^-$ content ($Br^-$ content: 60 mol % or more, preferably 80 mol % or more) and an $Ag^+$ salt solution to cause a layer having a high $Br^-$ content to deposit on the nuclei. It is believed that crystal defects are developed due to lattice constant disorder, halogen conversion, etc. during this procedure. It is preferred that the crystal defects are formed by the lattice constant disorder in which a phase having a high $Cl^-$ content ($Cl^-$ content: 60 mol % or more, preferably 80 mol % or more) is joined with a phase having a high $Br^-$ content.

In the case where the $Cl^-$ content of the AgX nuclei formed during nucleation is preferably in the range of 50 mol % or more, more preferably 80 mol % or more, further preferably 90 mol % or more (hereinafter referred to as "Case (B)"), the $Cl^-$ concentration in the dispersant solution during nucleation is preferably in the range of $10^{-1.5}$ mol/l or less, and the $Ag^+$ concentration thereof is preferably in the range of $10^{-2}$ mol/l or less. The pH value of the dispersant solution is preferably in the range of 2 or more, more preferably 5 to 10. The gelatin concentration of the dispersant solution is preferably in the range of 0.1 to 3% by weight, more preferably 0.2 to 2% by weight. The temperature in Case (B) is preferably in the range of 20° C. or higher, more preferably 30° to 85° C.

The $I^-$ content of the AgX nuclei formed during nucleation is preferably in the range of 10 mol % or less, more preferably 5 mol % or less in either Case A or Case B. On the other hand, the $Cl^-$ molar fraction is not specifically limited and may range from 0 to 100%.

2) Ripening Procedure

It is impossible to selectively form only tabular grain nuclei during nucleation. Accordingly, in the subsequent ripening procedure, Ostwald ripening is effected so that tabular grains are formed while other grains disappear. The ripening temperature is preferably 10° C. or higher, more preferably 20° C. or higher, higher than the nucleation temperature. It is normally in the range of 40° C. or higher, more preferably 50° to 90° C., further preferably 55° to 80° C. If the ripening temperature is 90° C. or higher, the ripening is preferably effected under a pressure of 1.2 or more times the atmospheric pressure. For the details of ripening under pressure, reference can be made to Japanese Patent Application No. 3-343180.

In Case (A), the following ripening conditions are preferred. Specifically, the excessive $Ag^+$ or $Br^-$ ion concentration during ripening is preferably in the range of $10^{-2.3}$ mol/l or less, more preferably $10^{-2.6}$ mol/l or less. The aspect ratio of the tabular grains obtained after ripening depends on the excessive $Ag^+$ or $Br^-$ ion concentration during ripening. Accordingly, if it is desired to finish the emulsion of the present invention at the end of the ripening procedure, it is necessary that the excessive ion concentration be adjusted to an optimum value by trial and error so that the aspect ratio of the tabular grains thus obtained is not too high or low and thus falls within the above specified range.

The optimum concentration varies with other ripening conditions (e.g., pH, temperature, gelatin concentration). Accordingly, it is preferably determined experimentally by trial and error depending on the conditions. Such a trial and error process can readily be carried out by persons skilled in the art without undue experimentation.

In Case (B), the excessive $Cl^-$ concentration during ripening is preferably in the range of $10^{-1.2}$ to $10^{-4}$ mol/l, more preferably $10^{-1.5}$ to $10^{-3}$ mol/l.

In the present invention, substantially no $NH_3$ is present in the system during ripening. "Substantially no $NH_3$" as defined herein means that the $NH_3$ concentration is less than 0.1 mol/l, preferably 0.05 mol/l or less, more preferably $10^{-2}$ mol/l or less. In addition to using substantially no $NH_3$, it is also preferred that substantially no other AgX solvents be present in the system. "Substantially no other AgX solvents" as defined herein means that the concentration $Z_0$ of AgX solvents other than $NH_3$ is preferably 0.5 mol/l or less, more preferably less than 0.1 mol/l, further preferably less than 0.02 mol/l. This is because the presence of any such solvents causes a rise in the fog density. During ripening, the silver salt solution and the $X^-$ salt solution may be added to the system at a low rate under various necessary conditions. A "low rate" as defined herein preferably indicates 30% or less, more preferably 20% or less of the critical addition rate.

The AgX emulsion of the present invention may be finished at the end of the ripening procedure, but a growth procedure is normally provided to satisfy the following requirements. These requirements are as follows: 1) to obtain emulsion grains having a desired grain size, 2) to increase the molar yield of AgX, and 3) to form, from these grains as core grains, a core/shell grain by depositing AgX layers having different halogen compositions or a multi-structure grain consisting of a core and two or more shell layers. If it is desired to finish the emulsion of the present invention at the end of the ripening procedure, it is necessary that the system be ripened until the total projected area of the tabular grains falls within the above specified range. If the ripening procedure is followed by a growth procedure, it is preferred that the total projected area of the tabular grains fall within the above specified range at the end of the ripening procedure.

The pH value of the system during ripening is normally in the range of 1 to 12, preferably 2 to 8, more preferably 2 to 6. The lower the pH value is, the lower is the fog density as well as the negative sensitivity. Accordingly, the most suitable combination of pH and pAg is preferably selected depending on the purpose. The ripening time is preferably in the range of 3 to 90 minutes, more preferably 5 to 50 minutes. Too short a ripening time means a rapid ripening, resulting in a poor reproducibility.

3) Growth Procedure

Referring first to Case (A), the growth procedure will be described. If crystal growth occurs when the excessive $Ag^+$ and $Br^-$ ion concentration is as close to the equivalent point as $10^{-2.3}$ mol/l or less, preferably $10^{-2.6}$ mol/l or less, grains grow preferentially in the edgewise direction. If the excessive ion concentration is in the range of $10^{-3}$ mol/l or less, the highest aspect ratio can be obtained, giving a main plane in the form of a rectangular parallelogram. The growth conditions may be selected such that the finally obtained AgX emulsion satisfies the foregoing requirements. As the $Ag^+$ concentration increases from the equivalent point and when the excessive $Ag^+$ concentration reaches more than $10^{-2.6}$ mol/l, the growth ratio in the thicknesswise direction increases while the main plane stays in the form of a rectangular parallelogram. As the $Br^-$ concentration increases from the equivalent point and when the excessive $Br^-$ concentration ranges from $10^{-4}$ mol/l to $10^{-2.3}$ mol/l, the growth ratio in the thicknesswise direction increases while the corners of the parallelogram are asymmetrically rounded. When the pBr value during the crystal growth is in the range for the production of octahedral grains (for AgBr, pBr is 2 or less), all four corners of the tabular grain are rounded, the edge surfaces are turned to a {111} plane, and the crystal grows in the thicknesswise direction to eventually form an octahedral grain. These conditions can be properly selected depending on the purpose to obtain a tabular grain which satisfies the foregoing aspect ratio requirement.

Examples of the method for the addition of solutes during crystal growth include 1) a method which comprises addition of a silver salt solution and an $X^-$ salt solution by a double jet process, 2) a method which comprises addition of a previously formed AgX fine grain emulsion, and 3) a method which combines Methods 1) and 2). Preferred among these methods is Method 2). This is because the supersaturation concentration during the grain growth is uniformly and closely controlled by the solubility of fine grains existing in the system. As in the case of parallel twining type tabular grains, in order to control x (where x is equal to rate of linear growth on main plane/rate of linear growth on edge) of the tabular grains, it is necessary that the supersaturation concentration be closely controlled. This coincides with the object of the present invention. In general, as the supersaturation concentration increases, x increases, giving a tendency for higher monodispersibility. On the contrary, as the supersaturation concentration decreases, x decreases, giving a tendency for higher polydispersibility. Accordingly, it is necessary that the supersaturation concentration be optimally and uniformly adjusted not too high and low. This can be accomplished by the finely divided grain addition method. This improves the monodispersibility of the tabular grains as compared with the conventional method.

In the possible mechanism of the selective growth of tabular grains on edges, the adsorption and subsequent desorption of solute ions on the main plane are repeated, and the solute ions are eventually deposited on the edges of the tabular grains to make a selective growth of edges. Considering the chemical equilibrium of solute ions between on the main plane, in the solution phase and on the edge on the basis of energy diagram, Gibbs-Helmholtz's equation and van't Hoff's constant-pressure equilibrium equation obtained from the chemical equilibrium equation ($\Delta G^\circ = -RT\ln Kp$) can be applied to determine the temperature change. Thus, this mechanism can be understood. In general, when the temperature is elevated, or the supersaturation degree is lowered in the supersaturation range so long as Ostwald ripening does not occur, the value of x is lowered. The growth of J-aggregates of sensitizing dyes in the AgX emulsion during ripening at an elevated temperature can be understood based on the same adsorption-desorption mechanism.

The diameter of the fine grains is preferably in the range of 0.15 μm or less, more preferably 0.1 μm or less, further preferably 0.006 to 0.06 μm. The fine grains may be continuously or intermittently added to the system. The emulsion of fine grains may be continuously prepared by supplying an $AgNO_3$ solution and an $X^-$ salt solution into a mixer provided in the vicinity of the reaction vessel, and then immediately charged continuously into the reaction vessel. Alternatively, the emulsion of fine grains may be batch-wise prepared in a separate vessel, and then continuously or intermittently charged into the reaction vessel. The emulsion of fine grains may be added to the system in the form of liquid or dried powder. It is preferred that the fine grains be substantially free of polytwinning grains. The term "polytwinning grain" as used herein means a grain having two or more twinning planes. The term "substantially free of polytwinning grains" as used herein means that the proportion of polytwinning grains by number is 5% or less, preferably 1% or less, more preferably 0 to 0.1%. It is further preferred that the fine grains be substantially free of monotwinning grains. It is still further preferred that the fine grains be substantially free of screw dislocations. The terms "substantially free of monotwinning grains" and "substantially free of screw dislocations" as used herein indicate that the proportion of monotwining grains or proportion of screw dislocation by number is 5% or less, preferably 1% or less, more preferably 0 to 0.1%.

The halogen composition of the fine grains is AgCl, AgBr, AgBrI ($I^-$ content is preferably in the range of 20 mol % or less, more preferably 10 mol % or less, further preferably 5 mol % or less) or mixed crystals of two or more of these halides.

The solution conditions during the grain growth are the same as during the ripening procedure. This is because both of the two procedures have the same mechanism that Ostwald ripening is effected to allow tabular grains to grow and cause other fine grains to disappear. For the general details of the method of adding the emulsion of fine grains, reference can be made to Japanese Patent Application No. 4-77261, JP-A-4-34544 and JP-A-1-183417. In order to obtain fine grains substantially free of twinning planes, an $Ag^+$ salt solution and an $X^-$ salt solution may be added to the system by a double jet process with the excessive $X^-$ concentration or excessive $Ag^+$ concentration being preferably in the range of $10^{-2}$ mol/l or less. However, dislocation defects easily occur under these conditions. In order to form fine grains free of such defects, the double jet process may be effected with substantially no different halogen impurities being present in the system under these conditions. The term "different halogen impurities" as used herein means $X^-$ salts other than $X^-$ salts to be added. Specifically, if an $Ag^+$ salt solution and a $Br^-$ salt solution are added, these different halogen impurities are $Cl^-$ and $I^-$. If an $Ag^+$ salt solution and a $Cl^-$ salt solution are added, these different halogen impurities are $Br^-$ and $I^-$. In other words, it is necessary that AgX nuclei having a uniform composition be formed. The term "substantially no different halogen impurities" as used herein preferably indicates $10^{-3}$ mol/l or less, more preferably $10^{-4}$ mol/l or less, including the content of impurities $X^-$ in the dispersant. The temperature at which the fine grains are formed is preferably in the range of 50° C. or lower, more preferably 5° to 40° C., further preferably 10° to 30° C. The dispersant preferably comprises a low molecular gelatin preferably having a molecular weight of 2,000 to $6\times10^4$, more preferably 5,000 to $4\times10^4$ in an amount of 30% by weight or more, more preferably 60% by weight or more, further preferably 80% by weight or more. The dispersant concentration is preferably 0.2% by weight or more, more preferably 0.5 to 5% by weight.

The grains which have grown through the fine grain addition method are excellent in sensitivity and graininess.

The proportion of fine grains containing screw dislocations can be determined by allowing the fine grains to further grow with the same AgX composition in the vicinity of the same ion concentration of $Ag^+$ and $X^-$ at a high supersaturation concentration without producing new nuclei. In other words, it can be obtained by determining [(number of tabular grains+abnormally grown grains)/total number of grains] on a replica of emulsion grains photographed under a transmission electron microscope. Alternately, it can be obtained by determining (average volume of fine grains before ripening) /(average volume of tabular grains and abnormally grown grains) wherein the fine grains are ripened under the foregoing ripening conditions until the fine grains almost disappear and only tabular grains and abnormally grown grains are left.

In the above-mentioned Method 1) for the addition of solutes during crystal growth, an $Ag^+$ salt solution and an $X^-$ salt solution are added to the system by a double jet process at such a rate that substantially no new nuclei are produced to allow the desired tabular grains to grow. The term "substantially no new nuclei" as used herein means that the projected area proportion of new nuclei is preferably in the range of 10% or less, more preferably 1% or less, further 0.1% or less. The growth ratio of a tabular grain in the thicknesswise direction and edgewise direction can be selected by properly selecting the pAg value, pH value, temperature, supersaturation concentration, etc. of the solution during the grain growth. In general, as the concentration is separated from the foregoing equivalent point, or as the concentration of AgX solvent existing in the system increases, the growth ratio in the thicknesswise direction increases. On the other hand, if crystal growth occurs at a low supersaturation degree in the vicinity of the foregoing equivalent point, the crystal grows preferentially in the edgewise direction. The term "low supersaturation degree" as used herein means the state of adding at a rate of 70% or less, preferably 5 to 50% of the critical adding rate. The critical adding rate as defined herein means the adding rate above which new nuclei begin to be produced.

In order to control the supersaturation degree during the grain growth, the adding rate of $Ag^+$ salt and $X^-$ salt may be increased with respect to the duration of addition.

In addition, the foregoing finely divided grain addition method may be employed in combination with an ionic solution addition method. For the details of these addition methods, reference can be made to JP-A-2-146033, JP-A-3-21339, JP-A-3-246534, JP-A-4-193336, and JP-A-4-330427 (the term "JP-A" as used herein means an "unexamined published Japanese patent application").

The optimum pH, temperature and other conditions for the above-mentioned Method 1) and 3) are the same as that for Method 2).

4) Others

As the dispersant for nucleation, ripening and growth there may be used known a photographic dispersant. In general, a gelatin may be preferably used, more preferably an alkali-treated bone gelatin. A gelatin from which at least $Cl^-$ ions have been removed may be preferably used. More preferably, an empty gelatin obtained by removing cations and anions from a gelatin may be used. Further, an empty gelatin which has been subjected to oxidation treatment may be preferably used. For the details of the oxidation treatment, reference can be made to JP-A-62-157024, and JP-A-2-111940, and *Research Disclosure,* vol. 307, item 307105, November 1989, IX.

Such an empty gelatin can be obtained by, e.g., subjecting a gelatin to ion exchange with a cation exchange resin and an anion exchange resin.

The dispersant concentration in the dispersant solution during nucleation, ripening and growth is preferably in the range of 0.1% by weight or more, more preferably 0.2 to 10% by weight, further preferably 0.3 to 5% by weight. Further, a gelatin may be incorporated in the $Ag^+$ salt solution and/or $X^-$ salt solution to be added during nucleation, growth and formation of the foregoing fine grains. In this case, the gelatin concentration is preferably in the range of 0.1 to 5% by weight, more preferably 0.2 to 3% by weight. Such a gelatin may be advantageously added during nucleation to provide a more uniform nucleation. The concentration of such a gelatin is particularly preferably almost the same as that in the reaction vessel. The term "almost the same as that in the reaction vessel" as used herein means that (concentration difference/gelatin concentration in the reaction vessel) is preferably within 0.5, more preferably 0.25. This is because when the $Ag^+$ salt solution and $X^-$ salt solution are charged into the vessel solution below the surface of the liquid, no disunifomity in the gelatin concentration is caused in the vicinity of the addition site.

For the details of the tabular grains and the method for the formation thereof, reference can be made to Japanese Patent Application Nos. 4-77261, and 4-145031.

The AgX emulsion thus obtained may preferably be subjected to optimum chemical sensitization and spectral sensitization.

As the chemical sensitization, all methods and embodiments which are known or will be known can be applied to the present invention. For the details of the chemical sensitization methods, reference can be made to publications as described later.

In chalcogenide sensitization, known sensitizing agents as well as compounds described in the following publications can be used alone or in combination of two or more:

U.S. Pat. No. 3,442,653, Canadian Patent 800958, JP-A-4-25832, JP-A-4-109240, JP-A-4-271341, JP-A-4-204640, JP-A-4-333043 and JP-A-4-271341, and Japanese Patent Application No. 3-82929.

The amount of the chemical sensitizing agent is preferably in the range of $10^{-2}$ to $10^{-8}$ mol/mol AgX, more preferably in the range of $10^{-3}$ to $10^{-7}$ mol/mol AgX.

Examples of the shape of the main plane of the tabular grains obtained according to the present invention include the following shapes: (1) Rectangular parallelogram having an adjacent side ratio of less than 1.2 and one having an adjacent side ratio of 1.2 or more (the adjacent side ratio is preferably 5 or less, more preferably 3 or less, further preferably 2 or less); (2) Rectangular parallelogram having four corners asymmetrically rounded (this indicates that four corners are not identical) (For details, reference can be made to Japanese Patent Application No. 4-145031); and (3) Rectangular parallelogram having four corners symmetrically rounded. Preferred among these shapes are (1) and (2).

Figure 1B:
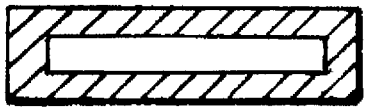
Figure 1C:
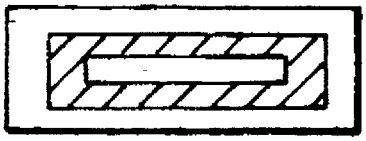
Figure 1D:
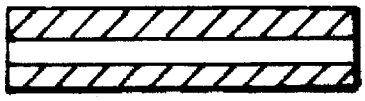
Figure 1E:
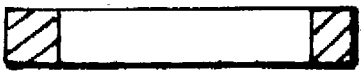
Figure 1F:
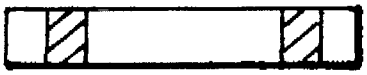
Figure 1G:
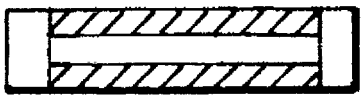

Examples of the intragrain halogen structure in the tabular grains include those shown in FIG. 1: (a) uniform halogen composition type, (b) double structure type in which the core and shell differ from each other in halogen composition, and (c) multi-structure type having a core layer and two or more shell layers. In the case of types (b) and (c), the $I^-$ content in the outermost layer may be either lower or higher than that in inner layers. These embodiments may be properly used depending on the purpose. For the details of the latter embodiment, reference can be made to JP-A-3-148648, JP-A-2-123345, JP-A-2-12142, and JP-A-1-284848.

The halogen composition change from layer to layer may be progressively increasing or decreasing or sharp depending on the purpose. For the details of the halogen composition change from layer to layer, reference can be made to JP-A-63-220238, JP-A-59-45438, JP-A-61-245151, JP-A-60-143331, and JP-A-63-92942. The $I^-$ content difference between layers is preferably in the range of 1 mol % or more, more preferably 2 to 10 mol %. The $Cl^-$ content difference between layers is preferably in the range of 1 mol % or more, more preferably 5 to 50 mol %. The thickness of the outermost layer and the interlayer each is preferably 3 lattice layers or more, more preferably 12 lattice layers to 0.5 μm. The thickness of core tabular grains in the innermost layer is preferably in the range of 0.04 μm or more, more preferably 0.06 to 0.6 μm.

Further examples of the intragrain structure include (d) sandwich structure type having selectively different halogen composition layers laminated on the upper and lower main planes of a tabular grain, (e) and (f) structure type having different halogen composition layers laminated on a tabular grain only in the edgewise direction, and (g) combinations of two or more of (b) to (f).

In the grains of the present invention, the production site and number per unit area ($cm^2$) of chemically sensitized nuclei are preferably controlled. For details, reference can be made to JP-A-2-828, JP-A-2-146033, JP-A-1-201651, JP-A-3-121445, JP-A-64-74540, JP-A-4-308840, and JP-A-4-343348, and Japanese Patent Application No. 3-140712.

In particular, the grain according to the structure (2) has at least a {100} plane and a {111} plane. An embodiment of this structure has chemically sensitized nuclei formed preferentially on the {111} plane using the difference in crystal habit between the {100} plane and the {111} plane. The term "preferentially on the {111} plane" as used herein means that y=[(number of chemically sensitized nuclei per $cm^2$ on the {111} plane)/(number of chemically sensitized nuclei per $cm^2$ on the {100} plane)] is preferably 2 or more, more preferably 4 or more. For the foregoing grain structures (a) to (g) and their details, reference can be made to Japanese Patent Application Nos. 4-77261, and 4-145031.

In the process of the present invention, substantially no $NH_3$ is present in the system during ripening. It is also preferred that substantially no $NH_3$ be present in the system during the nucleation procedure. The term "substantially no $NH_3$" as used herein means that the $NH_3$ concentration $Z_1$ is preferably 0.5 mol/l or less, more preferably less than 0.1 mol/l, further preferably less than 0.02 mol/l. It is further preferred that substantially no $NH_3$ be present in the system during the grain growth. The term "substantially no $NH_3$" as used herein indicates the above specified range of $Z_1$. In addition to using substantially no $NH_3$, it is preferred that substantially no other AgX solvents be present in the system during nucleation and grain growth. The term "substantially no other AgX solvents" as used herein indicates the above specified range of $Z_1$. Examples of AgX solvents other than $NH_3$ include fog inhibitors such as thioethers, thioureas, thiocyanic acids, organic amine compounds and tetrazaindene compounds. To the extent such AgX solvents are used, thioethers, thioureas, and thiocyanic acids are preferred. For details, reference can be made to publications as described later.

The tabular grains of the present invention are prepared under such conditions that fogged nuclei can easily occur. Accordingly, the resulting emulsion may exhibit a high fog density. In general, the higher the temperature is, or the higher the pH value is, or the higher the $Ag^+$ concentration is, the higher the fog will be. The fog developed in the procedure for the formation of tabular grains can be removed by oxidizing silver nuclei after each procedure or after all the procedures for the formation of grains. In other words, it can be accomplished by making the oxidation potential of the system higher than that of the silver nuclei. For details, reference can be made to Japanese Patent Application No. 4-145031.

In order to lower the fog density, a thiosulfonic compound may be added to the system during and after the formation of grains. For details, reference can be made to JP-A-4-156448, and EP 0435355A1, 0435270A1 and 0348934A2.

Dislocation lines can be introduced into grains during the formation of grains by the halogen composition gap method, halogen conversion method, epitaxial growth method or combinations thereof. This advantageously further improves the pressure fog characteristics, reciprocity law characteristics, and color sensitizability. For details, reference can be made to JP-A-63-220238, JP-A-64-26839, JP-A-2-127635, JP-A-3-189642, JP-A-3-175440, and JP-A-2-123346, EP 0460656A1, and *Journal of Imaging Science,* vol. 32, pp. 160–177 (1988).

Using the grains thus obtained as host grains, epitaxial grains may be formed. Using the grains as core grains, grains having dislocation lines thereinside may be formed. Further, using the grains as substrates, AgX layers having halogen compositions different from that of the substrates may be deposited to prepare grains having various known grain structures. For details, reference can be made to publications as described later.

Further, with the tabular grains as cores, a shallow internal latent image emulsion may be formed. Moreover, a core/shell type grain may be formed. For details, reference can be made to JP-A-59-133542, and JP-A-63-151618, and U.S. Pat. Nos. 3,206,313, 3,317,322, 3,761,276, 4,269,927, and 3,367,778.

An AgX emulsion prepared according to the process of the present invention may be blended with one or more other kinds of AgX emulsions. Alternately, two or more kinds of emulsion grains of the present invention having different grain diameters may be blended. The optimum blending proportion (mol of guest AgX emulsion/mol of AgX emulsion blended) may be properly selected between 0.01 and 0.99. The additives which can be added to these emulsions between the grain formation procedure and the coating procedure and the amount of these additives to be added are not specifically limited. All known photographic additives may be added to these emulsions in an optimum amount. Examples of these additives include doping agents for AgX grains (e.g., compounds of the Group VIII metals, other metallic compounds, chalcogen compounds), dispersants, fog inhibitors, sensitizing dyes (for blue, green, red, infrared, panchromatic, orthochromatic, etc.), supersensitizers, chemical sensitizers (sulfur, selenium, tellurium, gold compounds, compounds of the Group VIII noble metals, phosphor compounds, thiocyanates, reduction sensitizers, singly or in combination), fogging agents, emulsion precipitating agents, surface active agents, film hardeners, dyes, dye image forming agents, color photographic additives, soluble silver salts, latent image stabilizers, developers (e.g., hydroquinone compounds), pressure desensitization inhibitors, matting agents, antistatic agents, and dimensional stabilizers.

The AgX emulsion prepared according to the process of the present invention can be applied to any known photographic light-sensitive materials. Examples of such photographic light-sensitive materials include black-and-white silver halide photographic materials [e.g., X-ray photographic material, printing photographic material, photographic paper, negative film, microfilm, direct positive photographic material, ultrafine-grain dry plate photographic material (for LSI photomask, shadow mask, liquid mask)], and color photographic light-sensitive materials (e.g., negative film, photographic paper, reversal film, direct positive color photographic light-sensitive material, photographic material for silver dye bleach process). Further examples of these photographic light-sensitive materials include diffusion transfer photographic light-sensitive materials (e.g., color diffusion transfer element, silver salt diffusion transfer element), heat-developable photographic light-sensitive materials (black-and-white, color), high density digital recording materials, and photographic light-sensitive materials for holography. The coated amount of silver may be 0.01 g/m$^2$ or more.

The process (grain formation, desilvering, chemical sensitization, spectral sensitization, addition of photographic additives, etc.) and apparatus for the preparation of AgX grains, the structure of AgX grains, the support, the undercoating layer, the surface protective layer, the constitution of the photographic light-sensitive material (e.g., layer configuration, silver/coloring material molar ratio, silver amount ratio between layers), the form of product, the storage of product, the emulsion dispersion of photographic additives, the exposure, the development, etc. are not specifically limited. All techniques and embodiments which are known or will be known can be employed. For details, reference can be made to the following publications:

*Research Disclosure,* vol. 176 (Item 17643), (December 1978), vol. 307 (Item 307105, November 1989), Duffin, *Photographic Emulsion Chemistry,* Focal Press, New York, 1966, E. J. Birr, *Stabilization of Photographic Silver Halide Emulsion,* Focal Press, London, 1974, T. H. James, *The Theory of the Photographic Process,* 4th edition, Macmillan, New York, 1977, P. Glafkides, *Chimie et Physique Photographique,* 5th edition, *Edition del, Usine Nouvelle,* Paris, 1987, 2nd edition, Paul Montel, Paris (1957), V. L. Zelikman et al., *Making and Coating Photographic Emulsion,* Focal Press (1964), K. R. Hollister, *Journal of Imaging Science,* vol. 31, pp. 148–156 (1987), J. E. Maskasky, vol. 30, pp. 247–254 (1986), vol. 32, pp. 160–177 (1988), vol. 33, pp. 10–13 (1989), Frieser et al., *Die Grundlagern Der Photographischen Prozesse Mit Silver-halogeniden,* Akademische Verlaggesellschaft, Frankfurt (1968), Nikkakyo Geppo 1984, December, pp. 18–27, *Journal of Society of Photographic Science and Technology of Japan,* vol. 49, pp. 7–12 (1986), vol. 52, pp. 144–166 (1989), vol. 52, pp. 41–48 (1989), JP-A-58-113926 to JP-A-113928, JP-A-59-90841, JP-A-58-111936, JP-A-62-99751, JP-A-60-143331, JP-A-60-143332, JP-A-61-14630, JP-A-62-6251, JP-A-1-131541, JP-A-2-838, JP-A-2-146033, JP-A-3-155539, JP-A-3-200952, JP-A-3-246534, JP-A-4-34544, JP-A-2-28638, JP-A-4-109240, JP-A-2-73346, and JP-A-4-193336, other Japanese, U.S., European and International patents in the field of AgX photography, *Journal of Image Science, Journal of Photographic Science, Photographic Science and Engineering, Journal of Society of Photographic Science and Technology of Japan,* Journal of main purport of lectures at conferences of Society of Photographic Science and Technology of Japan, International Congress of Photographic Science and The International East-West Symposium on the Factors Influencing Photographic Sensitivity.

The present invention will be further described in the following examples, but the present invention should not be construed as being limited thereto.

EXAMPLE 1

Into a reaction vessel was charged an aqueous solution of a gelatin [comprising 1,200 cc of $H_2O$, 24 g of an empty gelatin and 5 cc of 1N $KNO_3$; pH 8.0]. To the material was added 10 cc of an $AgNO_3$ solution (containing 0.1 g/cc of $AgNO_3$) with stirring at a temperature of 40° C. The empty gelatin had a $Cl^-$ content of 10 ppm or less. After 5 minutes, 16 cc of an NaCl solution ($6.3\times10^{-4}$ g/cc) was added to the material. After 3 minutes, Ag-1 solution ($AgNO_3$: 0.2 g/cc) and Br-1 solution (KBr: 0.14 g/cc) were then added to the material by a double jet process at a rate of 48 cc/min. for 1 minute. After 1 minute, Br-2 solution (KBr: 0.035 g/cc) was added to the material in an amount of 18 cc at a rate of 10 cc/min. The emulsion was then adjusted with 1N $HNO_3$ to pH 5.2. The emulsion was then adjusted with an $AgNO_3$ solution and a KBr solution to a silver potential of 165 mV (with respect to a room temperature-saturated calomel electrode). The emulsion was then heated to a temperature of 67° C. while the pH value and silver potential were kept at 5.2 and 165 mv, respectively. The emulsion was then ripened for 10 minutes. Fine Emulsion-1 shown below was added to the emulsion in an amount of 0.06 mol as calculated in terms of AgX. The emulsion was then ripened for 10 minutes. Fine Emulsion-1 was further added to the emulsion in an amount of 0.1 mol as calculated in terms of AgX. The emulsion was then ripened for 10 minutes. This procedure was repeated three times. The emulsion was then ripened for 2 minutes. The emulsion was then cooled to a temperature of 45° C. Sensitizing Dye 1 shown below was then added to the emulsion in an amount of 65% of the saturated adsorption. The emulsion was then stirred for 10 minutes. To the emulsion was then added a precipitating agent. The emulsion was then cooled to a temperature of 27° C. The emulsion was then adjusted to a pH value of 4.0. The emulsion was then rinsed by an ordinary precipitation rinsing process. To the emulsion was then added an aqueous solution of a gelatin. The emulsion was then heated to a temperature of 40° C. The emulsion was then adjusted to pH 6.4 and pBr 2.8. A specimen was withdrawn from the emulsion. An electron microphotograph (TEM image) of a replica of the grains was observed. The results showed that 90% of the total projected area of all the AgX grains were tabular grains having a {100} plane as a main plane, an average grain diameter of 1.0 μm and an average aspect ratio of 6.7.

Sensitizing Dye 1

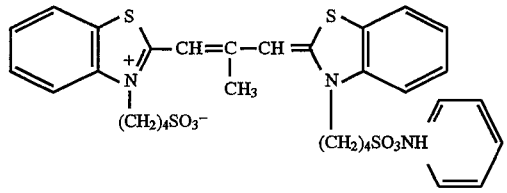

The emulsion was then heated to a temperature of 60° C. To the emulsion was then added an aqueous solution of triethylthiourea in a proportion of $6\times10^{-6}$ mol/mol AgX. After 5 minutes, a gold sensitizer (1:50 (molar ratio) aqueous solution of chloroauric acid: NaSCN) was then added to the emulsion in an amount of $4\times10^{-6}$ mol/mol AgX as calculated in terms of gold. After 30 minutes, the emulsion was then cooled to a temperature of 40° C. To the emulsion was then added a fog inhibitor TAI (4-hydroxy-6-methyl-1, 3,3a,7-tetrazaindene) in an amount of $10^{-3}$ mol/mol AgX. To the emulsion were then added a thickening agent and a coating aid. The emulsion was then coated on a TAC base together with a protective layer.

The material was then dried to obtain a Coating Specimen A.

Preparation of Fine Emulsion-1

Into a reaction vessel was charged an aqueous solution of a gelatin [comprising 1,200 cc of $H_2O$, 24 g of a gelatin having an average molecular weight of 30,000 (M3) and 0.3 g of KBr; pH 7.0]. To the material were then added Ag-1 solution (comprising 0.2 g/cc of $AgNO_3$, 0.01 g/cc of M3, and 0.25 cc/100 cc of a 1N $HNO_3$ solution) and X-1 solution (comprising 0.141 g/cc of KBr, $5.9\times10^{-4}$ g/cc of KI, 0.01 g/cc of M3, and 0.25 cc/100 cc of a 1N KOH solution) at a rate of 90 cc/min. for 3 minutes and 30 seconds with stirring at a temperature of 23° C. by a double jet process. The emulsion was then stirred for 1 minute. The emulsion was then adjusted to a pH value of 5.2 and a silver potential of 160 mV. After being prepared, the emulsion was immediately used for the experiment. The fine emulsion had an average grain diameter of about 0.04 μm.

COMPARATIVE EXAMPLE 1

In this example, the procedure was effected in the same manner as in Example 1 until ripening. To the emulsion was then added a KOH solution to adjust the emulsion to pH 7.0. To the emulsion were then added an $NH_4NO_3$ solution (50% by weight) and an $NH_3$ solution (7N) in equimolar amounts to adjust the $NH_3$ concentration thereof to 0.3 N. The emulsion was then heated to a temperature of 50° C. where it was ripened for 10 minutes. To the emulsion was then added an $HNO_3$ solution to adjust the emulsion to pH 5.2. The emulsion was then heated to a temperature of 67° C. The emulsion was then adjusted to a silver potential of 165 mV. To the emulsion were then added an $AgNO_3$ solution and a KBr solution in equimolar amounts at a rate of 0.006 mol/min. for 10 minutes by a double jet process. These solutions were further added at a rate of 0.01 mol/min. in equimolecular amounts for 30 minutes. The emulsion was then ripened for 2 minutes. The emulsion was then cooled to a temperature of 45° C. Thereafter, the procedure was effected in the same manner as in Example 1. Specifically, Sensitizing Dye 1 shown in Example 1 was then added to the emulsion. The emulsion was then subjected to precipitation rinsing and redispersion. A specimen was then withdrawn from the emulsion. A TEM image of a replica of grains was then observed. The results showed that 80% of the total projected area of all the AgX grains were tabular grains having a {100} plane as a main plane, an average grain diameter of 0.76 μm and an average aspect ratio of 3.0.

The emulsion was then heated to a temperature of 60° C. To the emulsion was then added an aqueous solution of triethylthiourea in a proportion of $5\times10^{-6}$ mol/mol AgX. After 5 minutes, the same gold sensitizer as used above in Example 1 was then added to the emulsion in an amount of $3\times10^{-6}$ mol/mol AgX as calculated in terms of gold. After 30 minutes, the emulsion was then cooled to a temperature of 40° C. To the emulsion was then added a fog inhibitor TAI in an amount of $10^{-3}$ mol/mol AgX. To the emulsion were then added a thickening agent and a coating aid. The emulsion was then coated on a TAC base together with a protective layer. The material was then dried to obtain a Coating Specimen B.

EXAMPLE 2

Into a reaction vessel was charged an aqueous solution of a gelatin [comprising 1,200 cc of $H_2O$, 6 g of an empty gelatin and 0.5 g of NaCl; pH 9.0]. To the material were then added Ag-1 solution (0.1 g/cc of $AgNO_3$) and Cl-1 solution (0.0345 g/cc of NaCl) at a rate of 15 cc/min. at a temperature of 65° C. with stirring for 12 minutes by a double jet process.

To the emulsion was then added a gelatin solution (comprising 100 cc of $H_2O$, 19 g of an empty gelatin and 1.3 g of NaCl). The emulsion was then adjusted with a 1N $HNO_3$ solution to pH 4.0. The emulsion was then heated to a temperature of 70° C. where it was ripened for 16 minutes. Fine Emulsion-2 described below was added to the emulsion in an amount of 0.1 mol as calculated in terms of AgX. The emulsion was then ripened for 15 minutes. Fine Emulsion-2 described below was then added to the emulsion in an amount of 0.15 mol as calculated in terms of AgX. The emulsion was then ripened for 15 minutes. This procedure was repeated twice. The emulsion was then ripened for 2 minutes. The emulsion was then cooled to a temperature of 45° C. The emulsion was then adjusted with NaOH solution to pH 5.2. Sensitizing Dye 1 shown in Example 1 was then added to the emulsion in an amount of 60% of the saturated adsorption. The emulsion was then stirred for 15 minutes. To the emulsion was then added a KBr solution (KBr: 1 g/100 cc) in an amount of 0.01 mol. The emulsion was then stirred for 5 minutes.

To the emulsion was then added a precipitating agent. The emulsion was then cooled to a temperature of 27° C. The emulsion was then adjusted to a pH value of 4.0. The emulsion was then rinsed by the ordinary precipitation rinsing process. To the emulsion was then added an aqueous solution of a gelatin. The emulsion was then heated to a temperature of 40° C. The emulsion was then adjusted to pH 6.4 and pCl 2.8. A specimen was withdrawn from the emulsion. A TEM image of a replica of the grains was observed. The results showed that 80% of the total projected area of all the AgX grains were tabular grains having a {100} plane as a main plane, an average grain diameter of 1.4 μm and an average aspect ratio of 6.5.

The emulsion was then heated to a temperature of 55° C. To the emulsion was then added an aqueous solution of hypo (0.01% by weight) in a proportion of $4\times10^{-6}$ mol/mol AgX. After 5 minutes, the same gold sensitizer as used above in Example 1 was then added to the emulsion in an amount of $1\times10^{-6}$ mol/mol AgX as calculated in terms of gold. After 30 minutes, the emulsion was then cooled to a temperature of 40° C. To the emulsion was then added a fog inhibitor TAI in an amount of $2\times10^{-3}$ mol/mol AgX. To the emulsion were then added a thickening agent and a coating aid. The emulsion was then coated on a TAC base together with a protective layer.

The material was then dried to obtain a Coating Specimen C.

Preparation of Fine Emulsion-2

Into a reaction vessel was charged an aqueous solution of a gelatin [comprising 1,200 cc of $H_2O$, 24 g of M3 and 10.5 g of NaCl; pH 3.0]. To the material were then added Ag-1 solution (comprising 0.2 g/cc of $AgNO_3$, 0.01 g/cc of M3, and 0.25 cc/100 cc of a 1N $HNO_3$ solution) and X-1 solution (comprising 0.07 g/cc of NaCl, 0.01 g/cc of M3, and 0.25 cc/100 cc of a 1N KOH solution) at a rate of 90 cc/min. for 3 minutes and 30 seconds with stirring at a temperature of 23° C. by a double jet process. The emulsion was then stirred for 1 minute. The emulsion was then adjusted to a pH value of 4.0 and a pCl value of 1.7.

COMPARATIVE EXAMPLE 2

In this example, the procedure was effected in the same manner as in Example 2 until ripening. To the emulsion was then added an NaOH solution to adjust the emulsion to pH 7.0. The emulsion was then heated to a temperature of 70° C. To the emulsion were then added an $NH_4NO_3$ solution (50% by weight) and an $NH_3$ solution (7N) in equimolar amounts to adjust the $NH_3$ concentration thereof to 0.2N. The emulsion was then ripened for 10 minutes. To the emulsion was then added an $AgNO_3$ solution and an NaCl solution at a rate of 0.01 mol/min. for 10 minutes in the equimolar amount by a double jet process. To the emulsion was then further added an $AgNO_3$ solution and an NaCl solution at a rate of 0.015 mol/min. for 20 minutes in the equimolar amount by a double jet process. The emulsion was then stirred for 2 minutes. To the emulsion was then added an $HNO_3$ solution to adjust the pH value thereof to 5.2. The emulsion was then cooled to a temperature of 45° C. Sensitizing Dye 1 shown in Example 1 was then added to the emulsion in an amount of 60% of the saturated adsorption. Thereafter, the procedure was effected in the same manner as in Example 2. A TEM image of a replica of the emulsion grains thus obtained was then observed. The results showed that 75% of the total projected area of all the AgX grains were tabular grains having a {100} plane as a main plane, an average grain diameter of 1.3 μm and an average aspect ratio of 5.5. The emulsion was then coated on a base to prepare a Coating Specimen D.

The Coating Specimens A to D were subjected to minus blue exposure through a wedge for 1/100 seconds, and then developed. For the Coating Specimens A and B, the development was effected with MAA-1 developer (see *Journal of Photographic Science,* vol. 23, pp. 249–256, 1975) at a temperature of 20° C. for 10 minutes. These specimens were passed through a stop bath and a fixing bath, rinsed, and then dried. The Coating Specimen A exhibited a fog density of 0.15 while the Coating Specimen B exhibited a fog density of 0.30. Thus, it was confirmed that the Coating Specimen A exhibits a low fog density as compared with the Coating Specimen B.

For the Coating Specimens C and D, the development was effected with MAA-1 developer comprising KBr replaced by NaCl in the equimolar amount at a temperature of 20° C. for 5 minutes. These specimens were passed through a stop bath and a fixing bath, rinsed, and then dried. The Coating Specimen C exhibited a fog density of 0.17 while the Coating Specimen D exhibited a fog density of 0.4. Thus, it was confirmed that the Coating Specimen C exhibits a low fog density as compared with the Coating Specimen D.

The results of photographic properties were as follows. Coating Specimen B of Comparative Example 1 exhibited a relative sensitivity of 100 and a graininess of 100 while Coating Specimen A of Example 1 exhibited a relative sensitivity of 115 and a graininess of 94. Thus, the effects of the present invention were confirmed.

COMPARATIVE EXAMPLE 3

Tabular AgBr grains were prepared in the same manner as in Example 3 of JP-B-64-8323 except that the initial dispersant solution comprised 60 g of an inactive gelatin and 3,000 ml of distilled water. The emulsion was processed in the same manner as in Example 1 of the present specification to prepare a Coating Specimen E. The tabular grains thus obtained exhibited an average aspect ratio of 12 and an average grain diameter of 1.2 μm.

The Coating Specimens A and E were folded at a constant rate around a 6-mm diameter steel rod with their emulsion sides positioned inside. After 20 minutes of the folding test, these specimens were then subjected to blue exposure through a continuous wedge for 1/100 seconds. These specimens were developed with MAA-1 developer at a temperature of 20° C. for 10 minutes, passed through a stop bath and a fixing bath, rinsed, and then dried. A comparison in fog density was made between unfolded specimens and folded specimens. The Coating Specimen A showed a fog density change from 0.15 to 0.17 while the Coating Specimen E showed a fog density change from 0.16 to 0.25. Thus, the Coating Specimen E showed a great pressure fog increase. Accordingly, it was confirmed that the tabular grains of the present invention exhibit a low pressure fog as compared with the tabular grains having an aspect ratio as high as 8 or more.

Fine Emulsion-1 and Fine Emulsion-2 each exhibit a screw dislocation proportion of 0.01% or less by number of grains as determined by the foregoing ripening process.

As mentioned above, the AgX emulsion according to the present invention comprises AgX grains 35% or more by total projected area of which are tabular grains having a {100} plane as a main plane and an average aspect ratio of 1.3 to 7.9. A photographic light-sensitive material comprising an AgX emulsion according to the present invention exhibits a low fog density, a low pressure fog, a high color sensitizability, a high sensitivity, and an excellent graininess.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising silver halide grains, 35% or more of the total projected area of said grains being occupied by tabular grains having a {100} plane as a main plane and having an average aspect ratio of 1.3 to 7.9 which have been prepared via at least nucleation and ripening procedures, wherein said ripening procedure is conducted with substantially no $NH_3$ present in the system, and wherein said tabular grains have screw dislocation defects, and said screw dislocation defects are formed by a lattice constant disorder in which a high AgBr phase containing 60 mol % or more of $Br^-$ is deposited on a high AgCl phase containing 60 mol % or more of $Cl^-$ in said nucleation procedure.

2. The silver halide photographic emulsion of claim 1, wherein said tabular grains are prepared via at least nucleation, ripening and growth procedures, and wherein said growth procedure is effected by the addition of finely divided silver halide grains substantially free of screw dislocation defects and having a diameter of 0.15 μm or less that causes crystal growth.

3. The silver halide photographic emulsion of claim 2, in which the finely divided silver halide grains are formed prior to and separately from the preparation of the tabular grains.

4. The silver halide photographic emulsion according to claim 1, wherein said ripening procedure is conducted at a temperature of 10° C. or more higher than the nucleation temperature and with the $NH_3$ concentration being less than 0.1 mol/l.

5. The silver halide photographic emulsion according to claim 1, wherein said ripening procedure is followed by a growth procedure which is effected by the addition of finely divided silver halide grains having a diameter of 0.15 μm or less that causes crystal growth.

6. The silver halide photographic emulsion according to claim 5, wherein said finely divided silver halide grains are formed prior to and separately from the preparation of the tabular grains and the proportion of grains having two or more twinning planes by number is 5% or less.

* * * * *